US007182070B2

(12) United States Patent
Magel

(10) Patent No.: US 7,182,070 B2
(45) Date of Patent: Feb. 27, 2007

(54) METHOD AND DEVICE FOR SHAPING THE INJECTION PRESSURE IN A FUEL INJECTOR

(75) Inventor: Hans-Christoph Magel, Pfullingen (DE)

(73) Assignee: Robert Bosch GmbH (DE)

( * ) Notice: Subject to any disclaimer, the term of this patent is extended or adjusted under 35 U.S.C. 154(b) by 31 days.

(21) Appl. No.: 11/123,067

(22) Filed: May 6, 2005

(65) Prior Publication Data

US 2005/0252490 A1 Nov. 17, 2005

(30) Foreign Application Priority Data

May 6, 2004 (DE) ..... 10 2004 022 267

(51) Int. Cl.
*F02M 57/02* (2006.01)
*F02M 37/04* (2006.01)

(52) U.S. Cl. ..... 123/496; 123/446; 123/467

(58) Field of Classification Search ..... 123/446, 123/467, 496
See application file for complete search history.

(56) References Cited

U.S. PATENT DOCUMENTS 5,651,345 A * 7/1997 Miller et al. ..... 123/446
6,085,726 A * 7/2000 Lei et al. ..... 123/446
RE37,633 E * 4/2002 Fuseya ..... 123/496
6,499,467 B1 * 12/2002 Morris et al. ..... 123/467
7,032,574 B2 * 4/2006 Sturman ..... 123/446
2004/0195387 A1 10/2004 Magel
2005/0263133 A1 * 12/2005 Magel ..... 123/446

FOREIGN PATENT DOCUMENTS

DE 102 47 903 A1 4/2004
EP 1 491 757 A1 12/2004
EP 1 584 813 A2 10/2005
EP 1 605 157 A1 12/2005
WO WO 2004/088122 A1 10/2004

* cited by examiner

*Primary Examiner*—Thomas Moulis
(74) *Attorney, Agent, or Firm*—Ronald E. Greigg

(57) ABSTRACT

A method for triggering a fuel injector via an on/off valve and a control valve that actuates it. The fuel injector has a pressure booster whose piston parts separate a working chamber from a differential pressure chamber. Via a compression chamber of the pressure booster, a nozzle chamber of the fuel injector can be acted on with highly pressurized fuel. The working chamber of the pressure booster communicates continuously with a common rail. During the main phase in which fuel is injected into the combustion chamber of an internal combustion engine, the control valve that actuates the on/off valve is triggered once or multiple times so that the maximum pressure level occurring at the combustion chamber end of a one-part or multipart injection valve member falls below the maximum achievable pressure level.

12 Claims, 2 Drawing Sheets

METHOD AND DEVICE FOR SHAPING THE INJECTION PRESSURE IN A FUEL INJECTOR

This application is based on German Patent Application 10 2004 022 267.3 filed May 6, 2004, upon which priority is claimed.

BACKGROUND OF THE INVENTION

1. Field of the Invention

It is possible to use both pressure-controlled and stroke-controlled injection systems to supply fuel to combustion chambers of autoignition internal combustion engines. In addition to unit fuel injectors, these fuel injection systems are also embodied in the form of unit pumps and accumulator (common rail) injection systems. Common rail injection systems, for example, advantageously permit the injection pressure to be adapted to the load and engine speed. It is generally necessary to achieve the highest injection pressure possible in order to achieve high specific loads and reduce engine emissions.

2. Description of the Prior Art

DE 101 23 910.6 relates to a fuel injection system that is used in an internal combustion engine. Fuel injectors supply fuel to the combustion chambers of the engine. A high-pressure source acts on the fuel injectors; the fuel injection system also includes a pressure booster that has a moving pressure boosting piston, which separates a chamber that can be connected to the high-pressure source from a high-pressure chamber connected to the fuel injector. The fuel pressure in the high-pressure chamber can be varied by filling a differential pressure chamber of the pressure booster with fuel or by emptying fuel from the differential pressure chamber of the pressure booster. The fuel injector has a moving closing piston for opening and closing injection openings. The closing piston protrudes into a closing pressure chamber so that fuel pressure can be exerted on the closing piston. This generates a force that acts on the closing piston in the closing direction. The closing pressure chamber and an additional chamber are comprised by a shared working chamber; all of the partial regions of the working chamber are connected to one another continuously to permit the exchange of fuel.

With this design, by triggering the pressure booster via the differential pressure chamber, it is possible to keep the triggering losses in the high-pressure fuel system significantly lower than a triggering by means of a working chamber that is connected to the high-pressure fuel source intermittently. In addition, the pressure in the high-pressure chamber is only relieved down to the pressure level of the common rail and not down to the leakage pressure level. On the one hand, this improves the hydraulic efficiency and on the other hand, it permits a more rapid pressure buildup to the peak pressure level so that the spaces of time between the injection phases can be shortened. According to the design known from DE 101 23 93913, the pressure booster and the injection nozzle are controlled by only a single valve, thus permitting the production of an inexpensive fuel injector that only takes up a small amount of space. This fuel injector permits a very high maximum injection pressure and features a variable hydraulic nozzle opening pressure so that even with small injection quantities, a high injection pressure can be achieved and the closing of the needle is significantly improved.

DE 102 29 417 A1 has disclosed a common rail injection system with a vario nozzle and a pressure boosting unit. A high-pressure fuel source supplies fuel to a fuel injector. A pressure booster is provided between an injection valve and the high-pressure fuel source. The pressure booster has a booster piston that separates a pressure chamber, which can be connected to the high-pressure fuel source, from a high-pressure chamber, which acts on a nozzle chamber of the fuel injector. The injection valve of the fuel injector has a nozzle needle that can open or close injection openings oriented toward a combustion chamber. The nozzle needle has a first nozzle needle part and an additional, second nozzle needle part, both of which are triggered in a pressure-dependent manner to open and close different injection cross sections in an injection nozzle. The two nozzle needle parts of the nozzle needle are guided one inside the other and have a surface that permits a hydraulic actuation. To this end, the first nozzle needle part has a pressure shoulder that can be actuated by means of the highly pressurized fuel flowing into a nozzle chamber. The second nozzle needle part has a pressure shoulder that is situated at the combustion chamber end of the second nozzle needle part.

The design known from DE 102 29 417 A1 permits the injection to be even better adapted to the requirements of the internal combustion engine. The opening pressure level of the inner needle part of the multipart injection valve member can be set to a constant, high level in a spring-assisted manner in order to prevent an opening in the partial load range of the internal combustion engine.

It has turned out that the setting of the opening pressure of the inner, second nozzle needle part of a multipart injection valve member is very tolerance-sensitive. An uncontrolled opening of the second, inner needle part of a multipart injection valve member leads to an abrupt jump in the injection quantity. Manufacture-conditional series tolerances with regard to the manufacturable tolerances therefore have a particularly negative effect with regard to the fuel supplied to the combustion chamber of an autoignition internal combustion engine.

With regard to the pressure fluctuations occurring in a common rail of the fuel injection system, therefore, the opening pressure of the inner, second needle part of a multipart injection valve member is very problematic. With regard to the opening pressure of the second, inner needle part of a multipart injection valve member, there is a critical pressure range during operation of the engine within which, due to the existing series tolerances of the fuel injectors and imprecisions in the pressure detection in the common rail, an indefinite opening of the second, inner needle part of the multipart injection valve member can occur, which can cause an indefinite quantity to be injected into the combustion chamber of the engine.

OBJECT AND SUMMARY OF THE INVENTION

In view of the technical disadvantages of the prior art outlined above, the present invention proposes a triggering method for influencing the pressure at which fuel is injected into the combustion chamber of an engine through a multiple triggering of an on/off valve that actuates the fuel injector during the main injection phase. According to the proposed triggering method, the on/off valve, which can be embodied, for example, in the form of a servo valve, is intermittently switched into a partially open state. In a critical pressure range in the common rail, this makes it possible to reduce the injection pressure at the needle parts of a multipart injection valve member and in particular, makes it possible to reliably prevent an undesired opening of the second, inner needle part of the multipart injection valve member.

According to the triggering method proposed by the present invention, after the beginning of the triggering of the main injection phase, which can be preceded by a preinjection phase in order to condition the combustion chamber, the on/off valve actuating the fuel injector is deactivated again for a short time before the maximum injection pressure against the multipart injection valve member is reached. The deactivation of the on/off valve that actuates the fuel injector can also occur sequentially in several steps. During the deactivation of the on/off valve that actuates the fuel injector, this on/off valve does not close completely, but instead executes only a partial closing motion so that the multipart injection valve member does not close all the way.

This makes it possible to reduce the maximum achievable injection pressure occurring at the combustion chamber end of the multipart injection valve member during the main injection phase. This in turn and makes it possible to reliably prevent the second, inner needle part of the multipart injection valve member from opening in a pressure range that is tolerance-critical with regard to the common rail. If a pressure range with regard to the common rail is finally reached in which an opening of the second, inner needle part of the multipart injection valve member is achieved for all of the fuel injectors used in the engine—taking into account the existing series tolerances, then the system switches over to a single activation. In single activation, the on/off valve is triggered once. Single activation of the on/off valve can easily include phases with different levels of activation current and different levels of triggering voltage. In solenoid valves, for example, a first, short starting current phase with a higher current is used, followed by an additional holding current phase with a lower current level.

As a result, the activation time, i.e. the opening time of the second, inner needle part of the multipart injection valve is exactly known and the correct quantity of fuel to be injected into the combustion chamber of the autoignition engine can be determined based on established characteristic curves.

The fuel injectors actuated by means of the proposed triggering method are advantageously designed so that they have a pronounced pressure maximum at the beginning of the main injection phase. This makes it possible for the maximum occurring injection pressure to be influenced in a particularly favorable way by means of a multiple triggering of the control valve, which can be embodied, for example, in the form of a solenoid valve and actuates a servo valve of a fuel injector, thus permitting an early activation of the second, inner needle part of a multipart injection valve member.

The triggering method proposed according to the present invention advantageously uses a servo valve as the on/off valve since its servo valve piston has a virtually linear opening and closing motion. Furthermore, in an on/off valve embodied in the form of a servo valve, the opening and closing speed of a valve piston can be ideally adapted to the requirements. The control valve that actuates the on/off valve embodied in the form of a servo valve and is so fast in operation that in the course of multiple activations, it passes through its complete stroke path and always reaches the open and closed, or stop positions. In the stop positions, no unstable condition appears because these positions are defined; any unstable condition existing only in te so called tolerance-sensitive ballistic range, i.e. between the stops.

The influencing of the injection pressure curve through multiple triggering of the actuation valve, which is embodied for example in the form of a control valve that actuates a servo valve, can also be used in a fuel injector that has a one-part injection valve member in order to optimally adapt the injection pressure curve to various operating states of the internal combustion engine. As a result, the injection pressure curve of the engine can be adapted to characteristic curve requirements without the need for modifications to the model-related basic designs of the fuel injectors used in the internal combustion engine.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
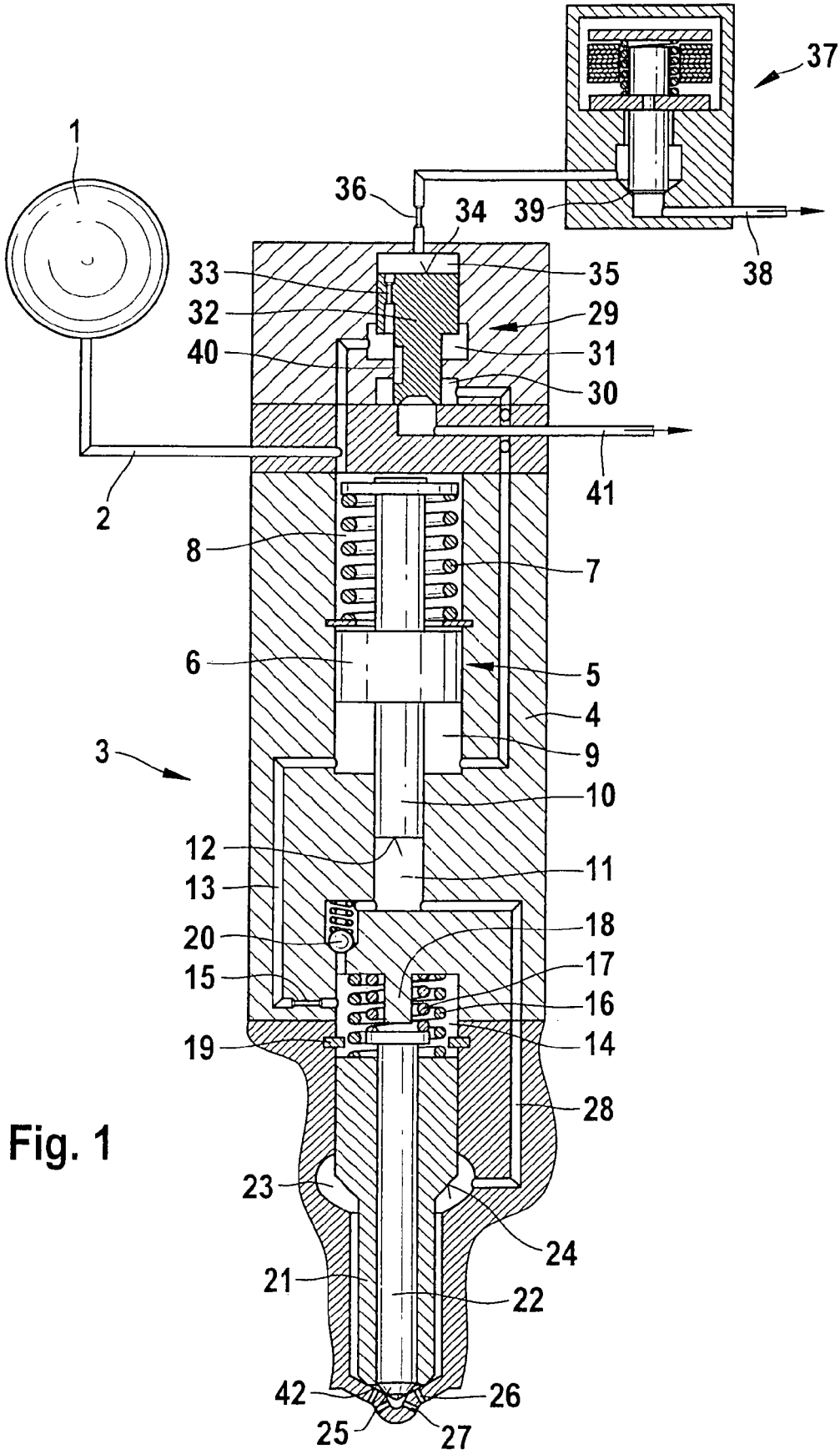
FIG. 1 shows a hydraulic circuit diagram of a fuel injector with a pressure booster that can be operated using the method proposed according to the present invention.

FIG. 1 shows a hydraulic circuit diagram of a fuel injector that can be triggered using the triggering method proposed according to the present invention. A common rail 1 is connected to a high-pressure line 2 and a fuel injector 3. The fuel injector 3 has an injector body 4, which has a multipart design to facilitate installation of the individual components. The injector body 4 contains a pressure booster 5. The pressure booster 5 has a first pressure booster piston part 6 and a second pressure booster piston part 10. The first pressure booster piston part 6 separates a working chamber 8 from a differential pressure chamber 9 of the pressure booster 5. The working chamber 8 contains a return spring 7. The high-pressure line 2 acts on the working chamber 8 of the pressure booster 5 with highly pressurized fuel. The pressure level exerted on the working chamber 8 of the pressure booster 5 depends on the pressure level prevailing in the common rail 1 (system pressure).

The end surface 12 of the second pressure booster piston part 10 acts on a compression chamber 11 of the pressure booster 5. A control line 13 leads from the differential pressure chamber 9 of the pressure booster 5 to a differential pressure chamber 14 that acts on a multipart injection valve member. A first throttle restriction 15 is provided in the control line 13. The differential pressure chamber 14 for acting on the multipart injection valve member contains a first spring element 16 and a second spring element 17. The first spring element 16 acts on a first, outer needle part 21 of the multipart injection valve member while the second spring element 17 acts on a second, inner needle part 22 of the multipart injection valve member. The differential pressure chamber 14 for acting on the multipart injection valve member contains an annular stop 19 and a pin 18 that is struck by an end surface of the second, inner needle part 22 that protrudes into the differential pressure chamber 14 of the multipart injection valve member. A check valve 20 for refilling the compression chamber 11 of the pressure booster 5 is provided between the differential pressure chamber 14 for acting on the multipart injection valve member and the compression chamber 11 of the pressure booster 5.

A nozzle chamber 23 is provided in the preferably multipart injector body 4. The outer, first needle part 21 of the multipart injection valve member has a pressure shoulder 24 inside the pressure chamber 23. The second, inner needle part 22 of the multipart injection valve member is provided with a pressure shoulder 25 at its end oriented toward the combustion chamber.

The first, outer needle part 21 opens and closes first injection openings 26 and the inner, second needle part 22 of the multipart injection valve member either opens or closes second injection openings 27. The first injection openings 26 serve to inject fuel into a combustion chamber, not shown in detail in FIG. 1, of the internal combustion engine at a first injection rate, whereas when the inner, second needle part 22 opens the second injection openings 27 as well, fuel can be injected into the combustion chamber of the autoignition internal combustion engine at a greater injection rate. A nozzle chamber inlet 28 leads from the compression chamber 11 of the pressure booster 5 to the nozzle chamber 23. The fuel compressed in the compression chamber 11 is conveyed into the nozzle chamber 23 via the nozzle chamber inlet 28 and generates a hydraulic force therein, which acts on the pressure shoulder 24 of the outer, first needle part 21 in the opening direction.

A discharge line leads from the differential pressure chamber 9 of the pressure booster 5 and feeds into a first hydraulic chamber 30 of a servo valve that serves as an on/off valve 29.

In addition to the first hydraulic chamber 30, the on/off valve 29, which is preferably embodied in the form of a servo valve, also has a second hydraulic chamber 31. These hydraulic chambers are connected to each other via a recess 40 in a valve piston 32. Inside the valve piston 32, a second throttle restriction 33 is provided underneath an end surface 34 of the valve piston 32. A pressure chamber 35 acts on the end surface 34 of the valve piston 32. A line with a third throttle restriction 36 integrated into it leads from the pressure chamber 35 to a control valve 37 preferably embodied in the form of a solenoid valve. The control valve 37 connects the pressure chamber 35 of the on/off valve 29 to a low-pressure return 38. The control valve 37 preferably embodied in the form of a solenoid valve includes a valve piston that can be actuated by means of an electromagnet and can completely open and close a valve seat 39 of the control valve 37.

At its end oriented away from the end surface 35, the on/off valve 29, which can preferably be embodied in the form of a servo valve, has a flat seat that can close a low-pressure chamber that is connected to a low-pressure return 41.

In the deactivated idle position, the differential pressure chamber 9 of the pressure booster 5 is acted on via the on/off valve 29 with the same pressure level (system pressure) as the working chamber 8 of the pressure booster 5. In this operating state of the fuel injector 3, the connection to the low-pressure region via the return 41 is closed. The pressure booster 5 is therefore pressure-balanced and no pressure boosting occurs; the two nozzle needle parts 21, 22 of the multipart injection valve member are closed in the deactivated state of the pressure booster 5.

To activate the fuel injector 3, the differential pressure chamber 9 of the pressure booster 5 is depressurized. To bring this about, the on/off valve 29 decouples the differential pressure chamber 9 of the pressure booster 5 from the pressure source, i.e. the common rail 1, and the pressure in the differential pressure chamber 9 is relieved to the low-pressure region pressure via the discharge line. As a result, the pressure in the compression chamber 11 of the pressure booster 5 increases, which occurs in accordance with the boosting ratio of the pressure booster 5. The nozzle chamber inlet 28 conveys this increased pressure to the injection nozzle, i.e. into the nozzle chamber 23. The hydraulic force acting on the pressure shoulder 24 of the first needle part 21 causes the first needle part 21 of the multipart injection valve member to open, thus opening the first injection openings 26 into the combustion chamber of the autoignition internal combustion engine. The differential pressure chamber 14 of the multipart injection valve member is also depressurized. The second spring element 17 sets the opening pressure acting on the second, inner needle part 22 of the multipart injection valve member. If the pressure at the tip, i.e. at the combustion chamber end of the second needle part 22, increases and exceeds the opening pressure, then the second, inner needle part 22 of the multipart injection valve member 21, 22 also opens. The pressure increase occurs inside a pressure chamber 42 that is delimited by the pressure shoulder 25, the nozzle body, and the end surface of the first, outer needle part 21.

In order to terminate the injection, the on/off valve 29 disconnects the differential pressure chamber 9 of the pressure booster 5 from the additional return 41 into the low-pressure region of the fuel injector 3 and connects it to the system pressure prevailing in the common rail 1. As a result, the system pressure builds up again in the differential pressure chamber 9 of the pressure booster 5, in the control line 13, and in the compression chamber 11. At the same time, the pressure in the nozzle chamber 23 falls to the system pressure level so that both needle parts 21, 22 of the multipart injection valve member close.

In the sequence of graphs shown in FIGS. 2–6, the strokes of the on/off valve 29 of the valve piston 32, the pressure curve at the injection nozzle, and the strokes of the first needle part 21 and the second needle part 22 of the multipart injection valve member are plotted over the time axis.

In order to prevent an unintentional opening of the second, inner needle part 22 within a critical system pressure range in the common rail 1, a multiple triggering of the on/off valve 29 can be executed.

Figure 2:
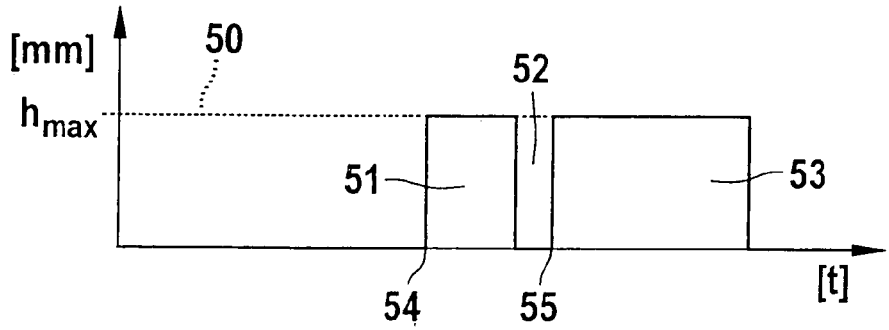
FIG. 2 shows the stroke curve of a control valve that actuates an actuation valve, plotted over time.

After the triggering start of the main injection phase, which can be preceded by a preinjection phase in which highly pressurized fuel is injected into the combustion chamber of the autoignition internal combustion engine, and before the maximum injection pressure level is reached at the combustion chamber end of the multipart injection valve member, the on/off valve 37 is deactivated for a short triggering pause 52. The triggering pause 52, which is depicted in FIG. 2, can also occur in a sequence of several steps after the first triggering phase 51 of the control valve 37. The triggering pause 52 is followed by a second triggering phase 52. The triggering start occurs at a first triggering time 54 for the first triggering phase 51 and occurs at a second triggering time 55 for the second triggering phase 53, as can be inferred from the depiction in FIG. 2.

Figure 3:
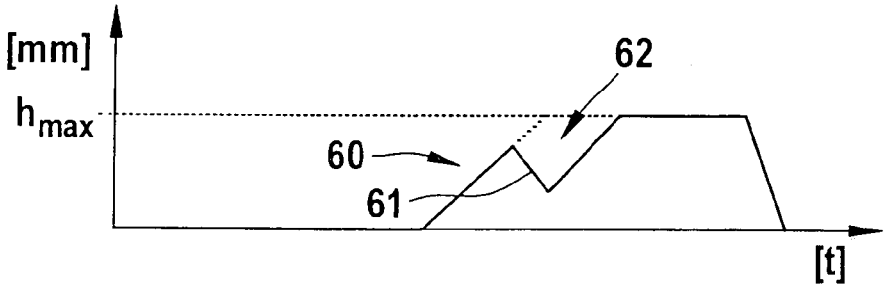
FIG. 3 shows the stroke curve of a valve piston of the control valve, plotted over time.

As a result, the valve piston 32 executes a partial closing motion 61. The stroke path of the on/off valve is labeled with the reference numeral 60. The partial closing motion 61 is dimensioned so as to prevent any abrupt decrease in pressure, thus preventing any complete closing of a multipart injection valve 21, 22. The valve piston 32 of the on/off valve 29 remains in an intermediate position 62 that is depicted in FIG. 3. The valve piston 32 of the control valve 29 assumes this intermediate position 62 during the triggering pause 52. As a result, during the main injection phase, the multipart injection valve member 21, 22 is exposed to a lower pressure that lies below the maximum achievable peak pressure level. This consequently prevents the second, inner needle part 22 of the multipart injection valve member from opening in the tolerance-critical pressure range of the pressure booster 1. The tolerance range of the opening pressure $P_O$, N2 that determines the opening of the second, inner needle part 22 of the multipart injection valve member is labeled with the reference numeral 71 in FIG. 4. The curve of the nozzle pressure 70 can be represented by a plateau 72 over which an excess pressure 73 is depicted with dashed lines.

After achievement of a pressure level inside the common rail 1 at which an opening of the second, inner needle part 22 of the multipart injection valve member is assured in all of the fuel injectors 3, taking into account the existing series tolerances, the system switches over to single activation. Single activation, i.e. a single triggering of the on/off valve, can easily also include phases with different levels of triggering current or triggering voltage. In on/off valves embodied in the form of solenoid valves, for example, a first, short starting current phase with a higher current level is typically used, followed by an additional, subsequent holding current phase with a lower current level.

An activation time 93 at which the second, inner needle part 22 of the multipart injection valve member opens is thus precisely known so that the correct injection quantity of fuel is determined by taking into consideration the corresponding characteristic curves that take the injection quantity into account.

Figure 5:
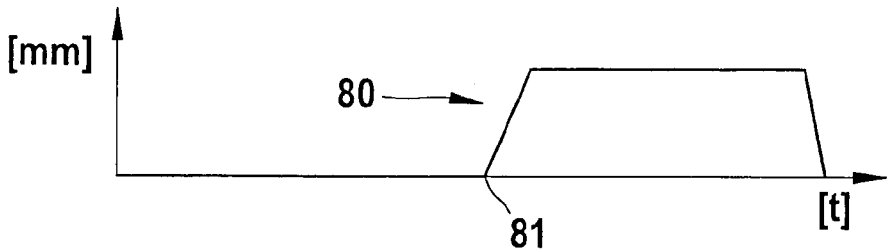
FIG. 5 shows the stroke path of a first, outer needle part of a multipart injection valve member.
Figure 6:
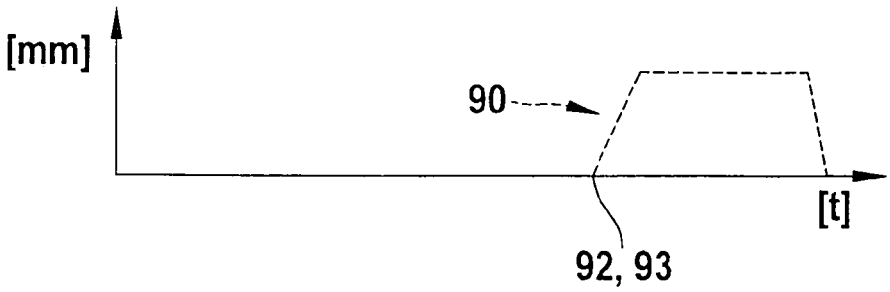
FIG. 6 shows the stroke path of a second, inner needle part of a multipart injection valve member.

FIGS. 5 and 6 show the stroke curves such as the stroke paths 80 or 90 of a first needle part 21 and of a second needle part 22. The reference numeral 81 indicates the opening time of the first needle part 21 and the reference numeral 92 indicates the opening time of the second, inner needle part on which the pressure surface 25 is provided. The opening start 92 of the second needle part 22 is identical to its activation time 93. Starting from the activation time 93, therefore, fuel is injected into the combustion chamber of the engine via both the first injection openings 26 and the second injection openings 27.

Figure 4:
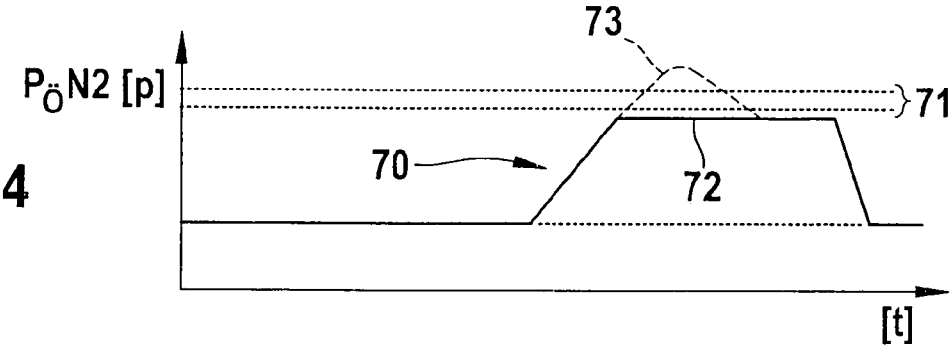
FIG. 4 shows the pressure curve in a multipart injection valve member.

The pressure curve 70 during an injection is depicted with dashed lines in FIG. 4 by means of an excess pressure 73. The opening of the second, inner needle part 22 of the multipart injection valve member is depicted with dashed lines in FIG. 6.

The above-outlined triggering method for multiple triggering of the control valve 37 for actuation of the on/off valve 27 can be used to particular advantage in fuel injectors 3 whose basic design is characterized by a pronounced pressure maximum at the start of the injection. This makes it possible to influence the maximum pressure in a favorable way through multiple triggering and an early activation time 93 of the second, inner needle part 22. If the second, inner needle part 22 has begun its opening motion, then the second, inner needle part 22 continues the opening motion by means of the additional force of pressure generated by a pressure shoulder 25 at the combustion chamber end of the second, inner needle 22, even if the nozzle pressure 70 falls below the opening pressure again.

The foregoing relates to preferred exemplary embodiments of the invention, it being understood that other variants and embodiments thereof are possible within the spirit and scope of the invention, the latter being defined by the appended claims.

I claim:

1. A method for shaping the injection curve of a fuel injector (3), which can be triggered via an on/off valve (29) that can be actuated by means of a control valve (37) and which has a pressure booster (5) for increasing the pressure level of fuel to be injected into a combustion chamber; the fuel injector (3) has a one-part or multipart injection valve member (21, 22) and the pressure booster (5) can be actuated through depressurization or pressurization of a differential pressure chamber (9); a working chamber (8) of the pressure booster (5) communicates continuously with a high-pressure source (1), the method comprising triggering the control valve (37) that triggers the on/off valve (29) once or multiple times during a main phase in which fuel is injected into a combustion chamber of an internal combustion engine in order to influence the injection pressure curve.

2. The method according to claim 1, wherein at least one triggering pause (52) is produced between a first triggering phase (51) of the control valve (37) and an additional triggering phase (53) of the control valve (37).

3. The method according to claim 2, wherein during the triggering pause (52) of the control valve (37), a valve piston (32) of the on/off valve (29) is caused to assume an intermediate position (62) between its open and closed positions.

4. The method according to claim 2, wherein as a result of the triggering pause (52) of the on/off valve (29) that actuates the fuel injector (3), the peak pressure level at the combustion chamber end of a multipart injection valve member (21, 22) falls below the maximum pressure level.

5. The method according to claim 1, wherein with multiple triggering of the control valve (37) which controls the on/off valve (29), this control valve (37) always executing its entire stroke path and actuates outside the ballistic range in its open and closed positions (39) in controlling the on/off valve (29).

6. A fuel injection system for executing the method according to claim 1, wherein the fuel injector 1 comprises a servo valve embodied in the form of an on/off valve (29) that is triggered by a control valve (37), which control valve can be actuated once or multiple times and is operated outside the ballistic range when triggered once or multiple times.

7. The fuel injection system according to claim 6, wherein the on/off valve (29) comprises a valve piston (32) containing a throttle restriction (33) via which a hydraulic chamber (31) and a pressure chamber (35) of the on/off valve (35) communicate with each other hydraulically.

8. The fuel injection system according to claim 6, wherein the on/off valve (29) comprises a valve piston (32) embodied in the form of a servo valve having a recess (40) that connects a second hydraulic chamber (30) and a first hydraulic chamber (31), via which a fuel volume flows out when the servo valve piston (32) is in a partially closed position.

9. The fuel injection system according to claim 6, further comprising a line that relieves the pressure in the differential pressure chamber (9) of the pressure booster (5) and that feeds a first hydraulic chamber (30) of the on/off valve (29).

10. The fuel injection system according to claim 6, further comprising a flat seat oriented away from an end surface (34) of a servo valve piston (32), the flat seat being able to open or close a low-pressure return (41) of the on/off valve (29).

11. The fuel injection system according to claim 6, wherein the fuel injector (3) has a one-part injection valve member (21, 22).

12. The fuel injection system according to claim 6, wherein the fuel injector (3) has a multipart injection valve member (21, 22).

* * * * *